US011091341B2

(12) United States Patent
Zappoli

(10) Patent No.: US 11,091,341 B2
(45) Date of Patent: Aug. 17, 2021

(54) APPARATUS AND METHOD FOR TREATMENT OF WRAPPING MATERIAL

(71) Applicant: PHILIP MORRIS PRODUCTS S.A., Neuchatel (CH)

(72) Inventor: Stefano Zappoli, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 16/489,035

(22) PCT Filed: Feb. 22, 2018

(86) PCT No.: PCT/EP2018/054391

§ 371 (c)(1),
(2) Date: Aug. 27, 2019

(87) PCT Pub. No.: WO2018/158133

PCT Pub. Date: Sep. 7, 2018

(65) Prior Publication Data

US 2020/0000140 A1 Jan. 2, 2020

(30) Foreign Application Priority Data

Feb. 28, 2017 (EP) ..... 17158343

(51) Int. Cl.
*A24C 5/10* (2006.01)
*B65H 27/00* (2006.01)
(Continued)

(52) U.S. Cl.
CPC ..... *B65H 27/00* (2013.01); *A24C 5/005* (2013.01); *A24C 5/10* (2013.01); *B65H 37/02* (2013.01);
(Continued)

(58) Field of Classification Search
CPC A24C 5/005; A24C 5/10; B65H 2301/51214; B65H 2301/512145; B65H 2801/54; B65H 27/00
(Continued)

(56) References Cited

U.S. PATENT DOCUMENTS 44,460 A 10/1864 Lockwood
2,924,223 A 2/1960 Miller
(Continued)

FOREIGN PATENT DOCUMENTS

CN 103221310 7/2013
CN 105745069 7/2016
(Continued)

OTHER PUBLICATIONS

PCT Search Report and Written Opinion for PCT/EP2018/054391 dated May 31, 2018 (13 pages).
(Continued)

*Primary Examiner* — Philip C Tucker
*Assistant Examiner* — John Blades
(74) *Attorney, Agent, or Firm* — Mueting Raasch Group

(57) ABSTRACT

The apparatus (10) for processing a continuous band of wrapping material (40) comprises a roller pair (20, 30) defining a roller gap (12) there between, wherein the rollers (20, 30) have matching convex and concave shapes, respectively. The invention is also directed to a corresponding method for treatment of wrapping material (40).

17 Claims, 5 Drawing Sheets

(51) Int. Cl.
*A24C 5/00* (2020.01)
*B65H 37/02* (2006.01)

(52) U.S. Cl.
CPC ..... *B65H 2301/5113* (2013.01); *B65H 2301/512145* (2013.01); *B65H 2404/1112* (2013.01); *B65H 2404/1113* (2013.01); *B65H 2801/54* (2013.01)

(58) Field of Classification Search
USPC ..... 156/200, 203, 461, 465, 466
See application file for complete search history.

(56) References Cited

U.S. PATENT DOCUMENTS 4,553,556 A 11/1985 Lephardt
5,066,270 A * 11/1991 Tomanovits ..... B31D 5/0004 493/435
5,350,126 A 9/1994 Irikura
5,978,645 A * 11/1999 Miyazaki ..... B65H 29/12 399/322
6,032,945 A 3/2000 Miura
2011/0248440 A1 10/2011 Sugiyama
2016/0288446 A1 10/2016 Sanna

FOREIGN PATENT DOCUMENTS

CN 205739630 11/2016
DE 69329315 T2 6/1993

OTHER PUBLICATIONS

International Preliminary Report on Patentability for PCT/EP2018/054391 dated May 13, 2019 (22 pages).
Office Action issued in China for Application No. 201880011788.2 dated Mar. 31, 2021 (15 pages). English translation included.

* cited by examiner (Prior Art)

APPARATUS AND METHOD FOR TREATMENT OF WRAPPING MATERIAL

This application is a U.S. National Stage Application of International Application No. PCT/EP2018/054391 filed Feb. 22, 2018, which was published in English on Sep. 7, 2018, as International Publication No. WO 2018/158133 A1. International Application No. PCT/EP2018/054391 claims priority to European Application No. 17158343.8 filed Feb. 28, 2017.

The present invention relates to an apparatus and a method for treatment of a flat band of wrapping material, before the wrapping material is used for forming a rod-shaped component to be used in manufacture of wrapped aerosol generating articles. In a conventional manufacturing process wrapping material may be processed in the following way. A flat band of wrapping material is unwound from a material bobbin. The wrapping material is then conveyed past a glue applicator unit, via which seam glue is applied on a side area of the wrapping material. The band of wrapping material paper then arrives on a "U-shaped" conveyor belt where a rod-shaped component of the aerosol generating articles is put on the wrapping material. Afterwards the "U-shaped" conveyor belt pulls the wrapping material and the component, into a specific device that closes the wrapping material on itself, whereby the side of the wrapping material with the seam glue is adhered to the other side of the wrapping material.

In this process glue may be applied in a line aligned with the longitudinal axis of the band of wrapping material. One line of glue, the "seam glue", is used to fix two sides of the wrapping paper inside which is a component of the aerosol generating articles.

One of the parameters used for judging the quality of the wrapped product is the ovality of the final wrapped rod. It has been noticed that the wrapping material, in the area where the seam glue is applied, may become stiff and flat when arriving at the "U-shaped" conveyor belt. This increased stiffness of the wrapping material may influence the resulting ovality of the wrapped product.

The present invention therefore aims at treating the wrapping material in such way that the wrapping material maintains its flexibility after receiving the seam glue, such that a desired ovality of the final product may be achieved.

According to a first aspect of the invention there is provided an apparatus for processing a continuous band of wrapping material, comprising a roller pair defining a roller gap there between, wherein the rollers have matching convex and concave shapes, respectively.

The rollers have matching convex and concave shapes, respectively, such that the rollers are adapted to provide a continuous weakened region of the continuous band of wrapping material by bending or displacing the continuous weakened region relative to another region of the continuous band of wrapping material when the continuous band of wrapping material is guided through the roller gap.

The rollers hence may be adapted to provide a continuous weakened region of the continuous band of wrapping material by bending the continuous weakened region out of the plane defined by the continuous band of wrapping material. The matching convex and concave shapes of the rollers thus are adapted to bend a continuous region of the continuous band of wrapping material out of the plane defined by the continuous band of wrapping material so as to provide a continuous weakened region of the continuous band of wrapping material.

The bending or displacing of the continuous weakened region by the matching convex and concave shapes of the rollers is along the width of the continuous band of wrapping material which means along a direction orthogonal to the processing direction.

The matching convex and concave shapes of the rollers may be adapted such that the rollers have substantially engaging surface profiles over substantially the entire roller surfaces. Therefore, the roller surfaces may define a roller gap of constant width over substantially the whole length of the roller gap for each rotational orientation of the rollers.

Each of the rollers may have a stationary profile along its direction of rotation. This means that both rollers may have a stationary cross-section along their direction of rotation such that the convex and concave shapes are identical for each angle of rotation of the rollers. Accordingly, each roller may have rotational symmetry.

The rollers having rotational symmetry allow for the continuous band of wrapping material to be evenly bent or displaced along the processing direction as the band of wrapping material is continuously guided through the roller gap. Accordingly, the weakened region of the continuous band of wrapping material may be continuously and evenly weakened along the length of the continuous band of wrapping material in the processing direction.

The continuous weakened region may comprise or may consist of a continuous weakened lateral edge portion of the continuous band of wrapping material. Thus, the rollers may have matching convex and concave shapes, respectively, such that the rollers are adapted to provide a continuous weakened lateral edge portion of the continuous band of wrapping material by displacing the continuous weakened lateral edge portion relative to a central area of the continuous band of wrapping material.

With the present apparatus it is possible to prepare a continuous band of wrapping material for subsequent processing, in particular for subsequently wrapping the material around any desired rod-shaped element used in manufacture of aerosol generating articles.

The concavo-convex shape of the rollers as well their disposition inside the apparatus assist in weakening the wrapping material, in particular in the lateral areas where the seam glue will be applied, so that the wrapping material will not get stiff after receiving the seam glue and so that the desired ovality of the final product will be achieved.

The wrapping material to be treated with the apparatus of the present invention may be any continuous band of sheet-like material that is suitable for forming a rod-shaped component in manufacture of aerosol generating articles. Particular suitable material is wrapping paper made from cellulosic material. Other useful materials may include leather, plastic or polymeric materials. The wrapping material is typically provided in the form of a band of continuous sheet-like or flat material having a predetermined width.

The roller pair comprises a male and a female roller which have corresponding shapes so as to define a roller gap of constant width. The width of the roller gap may be constant along substantially the entire width of the rollers along an axial direction of the rollers. Both rollers may have the same width. The width of the rollers may be substantially equal to the width of the continuous band of wrapping material to be processed.

Both rollers have substantially flat central roller areas with correspondingly rounded edges. The rollers form a male/female roller couple. The female roller has convexly rounded edges, and the male roller has corresponding concavely rounded edges.

As used herein the expression "concave" curvature denotes a roller, having edges that protrude with respect to the central roller surface. As used herein the expression "convex" curvature denotes a roller, having edges that are recessed with respect to the central roller surface.

By providing the rollers with a substantially flat central roller surface having curved edges, in particular the lateral portions of the continuous band of wrapping material are weakened. As these lateral portions are typically provided with seam glue and are therefore particularly prone to getting stiff during a subsequent wrapping process, it is particularly important that these lateral areas maintain their flexibility during a subsequent wrapping procedure.

The wrapping material is guided through the full width of the roller gap, including the flat central portion of the roller gap and the lateral concavo-convex portions of the roller gap. The advantageous effect of the present invention, namely softening of the lateral areas of the wrapping material, is obtained in particular for those areas of the wrapping material that is guided through the concavo-convex portion of the roller gap.

The region of the continuous band of wrapping material which is passing between the concavo-convex portion of the roller gap is bent or displaced relative to the region of the continuous band of wrapping material which is not passing between the concavo-convex portion of the roller gap. If a flat central portion of the roller gap is present the region of the continuous band of wrapping material which is passing between the concavo-convex portion of the roller gap is bent out of the plane defined by the region of the continuous band of wrapping material which is passing between the flat central portion of the roller gap.

By the step of bending or displacing, the region of the continuous band of wrapping material which is passing between the concavo-convex portion of the roller gap is weakened or, in other words, is softened. The region of the continuous band of wrapping material which is passing between the concavo-convex portion of the roller gap is also referred to as the weakened region of the continuous band of wrapping material.

The weakened region of the continuous band of wrapping material may be a lateral portion of the continuous band of wrapping material. The lateral portion may be a region at least contiguous with a lateral edge of the continuous band of wrapping material. The lateral portion may be a lateral edge portion of the continuous band of wrapping material.

The weakened region being a lateral portion of the continuous band of wrapping material may comprise one or both of the lateral portions of the continuous band of wrapping material.

Alternatively or in addition, the weakened region may comprise a central portion of the continuous band of wrapping material.

The dimensions of the rollers may be adapted to the dimensions of the wrapping material. The rollers may have a diameter of between 10 and 50 millimeters, and may have a diameter of about 30 millimeters. Unless otherwise indicated, the diameter of the rollers is the diameter as measured at the center of the rollers.

The width of the rollers may range between 15 and 40 millimeters, may range between 20 and 30 millimeters, and may amount to about 26 millimeters. These dimensions correspond to the dimensions of typically used wrapping materials.

The rounded corners of the rollers may have any desired radius of curvature as demanded by the wrapping material or the subsequent processes carried out on the wrapping material. The rounded corners of the rollers may have radius of curvature of between 1 and 5 millimeters and preferably of about 3 millimeters. The radius of curvature determines the width of the lateral area that is treated with the apparatus of the present invention. The radius of curvature also determines the width of the lateral areas of the wrapping material that is softened by the apparatus of the present invention.

The apparatus may comprise a plurality of the above mentioned roller pairs. The roller pairs may be arranged successively along a processing direction of the wrapping material. The roller pairs may be arranged in alternating orientation along the processing direction of the band of wrapping material. The expression "alternating orientation" is to be construed such that the roller pairs are oriented such that in the processing direction of the wrapping material the wrapping material is alternately guided through a roller gap defined by a roller pair in which the convex shaped roller is on top of the plane defined by the wrapping material, and subsequently through a roller gap defined by a roller pair in which the concave roller is on top of the plane defined by the wrapping material.

In a particularly useful embodiment the apparatus comprises four roller pairs, which are arranged in alternating orientation along the processing direction of the continuous band of wrapping material.

By using a plurality of roller pairs which are arranged in alternating orientation along the processing direction of the wrapping material, the lateral regions of the wrapping material are alternately bent upward and downward with respect to the plane defined by the wrapping material. The repeated bending of the lateral regions in opposite directions weakens the wrapping material. If the wrapping material is a cellulosic material such as wrapping paper, the repeated bending may break or weaken in particular those fibers that are orientated perpendicular to the processing direction of the wrapping paper.

The rollers of each pair may all have the same diameter and may be mounted such that the top rollers and the bottom rollers of each pair are located at the same height. In such embodiment the central portion of the wrapping material is guided rectilinearly through the apparatus without being deflected out of the plane defined by the wrapping material. Accordingly the central portion of the wrapping material largely retains its original material properties, and only the lateral regions of the wrapping material are softened and weakened by the apparatus.

The roller pairs may also alternately be located at different heights, such that consecutive roller gaps are alternately arranged at different heights. Thus, on its way through the apparatus the wrapping material is additionally bent up and down with respect to the processing direction of the wrapping material. This embodiment also affects flexibility of the central portion of the material. If the wrapping material is a cellulosic material such as wrapping paper, this additional treatment may weaken in particular those fibers that are orientated in parallel to the processing direction of the wrapping paper.

The apparatus may further comprise a closing device for controlling the contact pressure between the one or more roller pairs. The closing device may be any suitable device that is known in this respect to a skilled person. By controlling the contact pressure, it is possible to adjust the apparatus to the specific wrapping material to be treated in a given process.

The closing device may comprise adjustable resilient elements, such as tension springs, for controlling the contact pressure between each roller pair. Each roller pair may be connected to a separate closing device. The apparatus may also comprise a single closing device which controls the contact pressure of all roller pairs simultaneously.

In an embodiment the top rollers of each roller pair are mounted to an upper support plate and the bottom rollers of each roller pair are mounted to a lower support plate. In this embodiment the closing device may be provided in the form of two tension springs mounted between the upper and lower support plate.

The apparatus may further comprise a glue applicator that is configured to apply glue to a lateral area of the band of wrapping material. The glue may be provided to an area of the wrapping material that has been guided through the non-flat or rounded area of the roller gap.

The apparatus may comprise a glue applicator, wherein the glue applicator is configured to be capable of applying glue to a lateral area of the continuous band of wrapping material that has been guided through the curved area of the roller gap.

In another aspect the present invention is directed to a method for processing a band of wrapping material. The method comprises the steps of providing a continuous band of wrapping material, guiding the continuous band of wrapping material through a roller gap defined by a roller pair, wherein the rollers have matching convex and concave shapes, respectively.

The rollers have matching convex and concave shapes, respectively, such that the rollers provide a continuous weakened region of the continuous band of wrapping material by displacing the region of the continuous band of wrapping material which is passing between the concavo-convex portion of the roller gap relative to the region of the continuous band of wrapping material which is passing between the flat central portion of the roller gap.

The rollers may have matching convex and concave shapes, respectively, such that the rollers provide a continuous weakened lateral edge portion of the continuous band of wrapping material.

The method may further comprise the step of providing a plurality of roller pairs. The roller pairs may be arranged successively along a processing direction of the wrapping material. The roller pairs may be arranged in alternating orientation along the processing direction of the continuous band of wrapping material.

By guiding the continuous band of wrapping material through a plurality of roller pairs which are arranged in alternating orientation along the processing direction of the wrapping material, the lateral regions of the wrapping material are alternately bent upward and downward with respect to the plane defined by the wrapping material. With this treatment the internal structure of the wrapping material is weakened and its flexibility is increased. If the wrapping material is a cellulosic material such as wrapping paper, the repeated bending may break or weaken in particular those fibers that are orientated perpendicular to the processing direction of the wrapping paper.

The method may further comprise the step of providing a plurality of roller pairs in alternating heights with respect to the processing direction of the band of wrapping material.

The method may further comprise the step of controlling the contact pressure between the roller pair via a closing device.

The method may further comprise the step of applying glue to a lateral area of the band of wrapping material. The glue may be provided to an area of the wrapping material that has been guided through the non-flat or rounded area of the roller gap.

The method may further comprise the step of wrapping the wrapping material around a rod-shaped element to form a wrapped component that may be used in manufacture of aerosol generating articles.

By softening the lateral areas of the wrapping material and by applying the glue to these lateral areas of the band of wrapping material, the flexibility of the wrapping material is sufficiently increased such that the resulting wrapped component may be produced with a predefined and desired ovality.

This disclosure is also directed to a wrapped component obtainable by the method of the present invention. The wrapped component may be a filter element such as a cellulose acetate filter, a hollow acetate tube or a wrapped plug of aerosol forming substrate. The wrapped components obtained by the present invention may have a superior ovality as compared with conventionally manufactured wrapped components.

Features described in relation to one aspect may equally be applied to other aspects of the invention.

The invention will be further described, by way of example only, with reference to the accompanying drawings in which.

Figure 1:
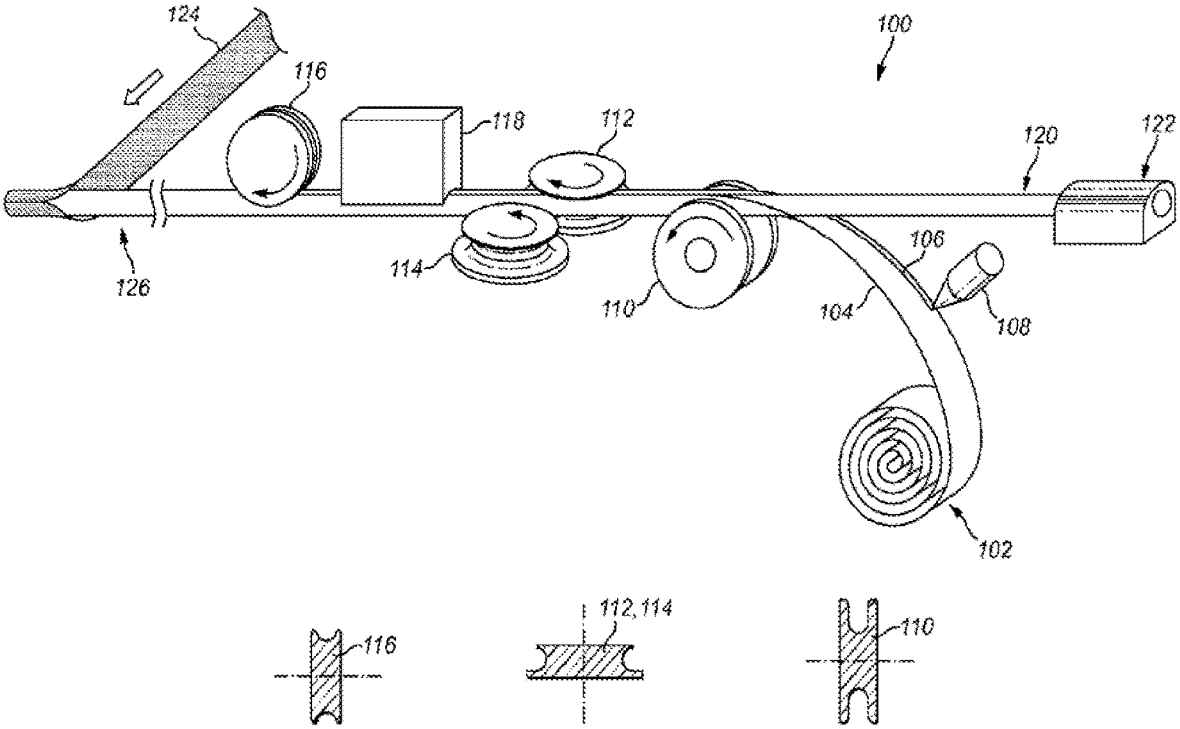
FIG. 1 shows a prior art wrapping device.

FIG. 1 shows a conventionally used wrapping device as known from US patent application No. 2016/0120216. In the apparatus disclosed therein, a flat continuous band of wrapping material is unwound from a material bobbin. The wrapping material is then conveyed past a glue applicator unit, via which seam glue is applied on a side area of the wrapping material. The band of wrapping material paper band is then wound around a rod shaped mandrel. A first roller having a convex or "U-shaped" roller surface presses the wrapping material against the mandrel. A further roller pair with each roller having a convex or "U-shaped" roller surface closes the wrapping material on itself, whereby the side of the wrapping material with the seam glue is adhered to the other side of the wrapping material. The seam glue is then cured in a downstream heating device.

Figure 2:
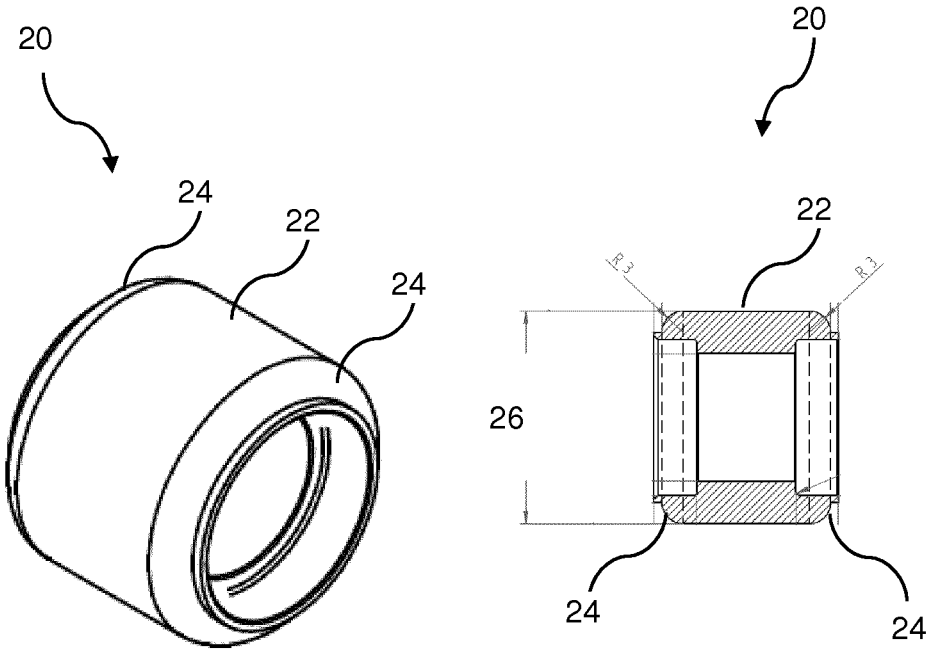
FIG. 2 shows a female roller for use in the apparatus of the present invention.
Figure 3:
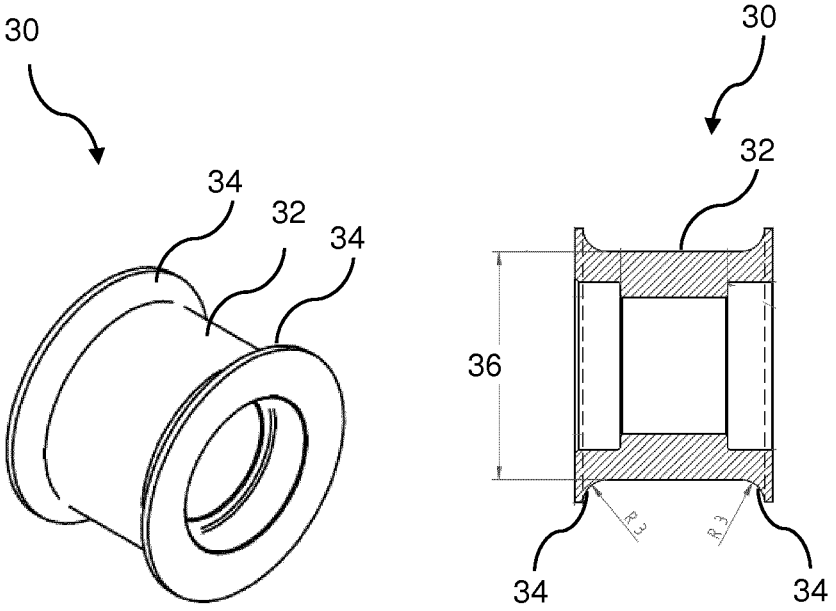
FIG. 3 shows a male roller for use in the apparatus of the present invention.

In FIGS. 2 and 3 suitable rollers for the apparatus for treating wrapping material according to the present invention are depicted. The roller depicted in FIG. 2 is a female roller 20 having a generally flat central roller surface area 22 with convexly rounded edges 24. The diameter 26 of the female roller 20, measured at the flat central surface area 22, amounts to 30 millimeters. The overall width of the roller is 26 millimeter. The width of the central roller surface 22 amounts to 20 millimeters. Each of the two edges 24 of the female roller 20 exhibit a convex curvature having a radius of 3 millimeters.

The roller depicted in FIG. 3 is a male roller 30, whose roller surface matches the roller surface of the female roller 20 of FIG. 2. The male roller 30 has a generally flat central roller surface area 32 with concavely rounded edges 34. The diameter 36 of the male roller 30, measured at the flat central surface area 32, also amounts to 30 millimeters. The overall width of the roller is 26 millimeter. The width of the central roller surface area 32 amounts to 20 millimeters. Each of the two edges 34 of the male roller 30 exhibit a concave curvature having a radius of 3 millimeters.

Figure 4:
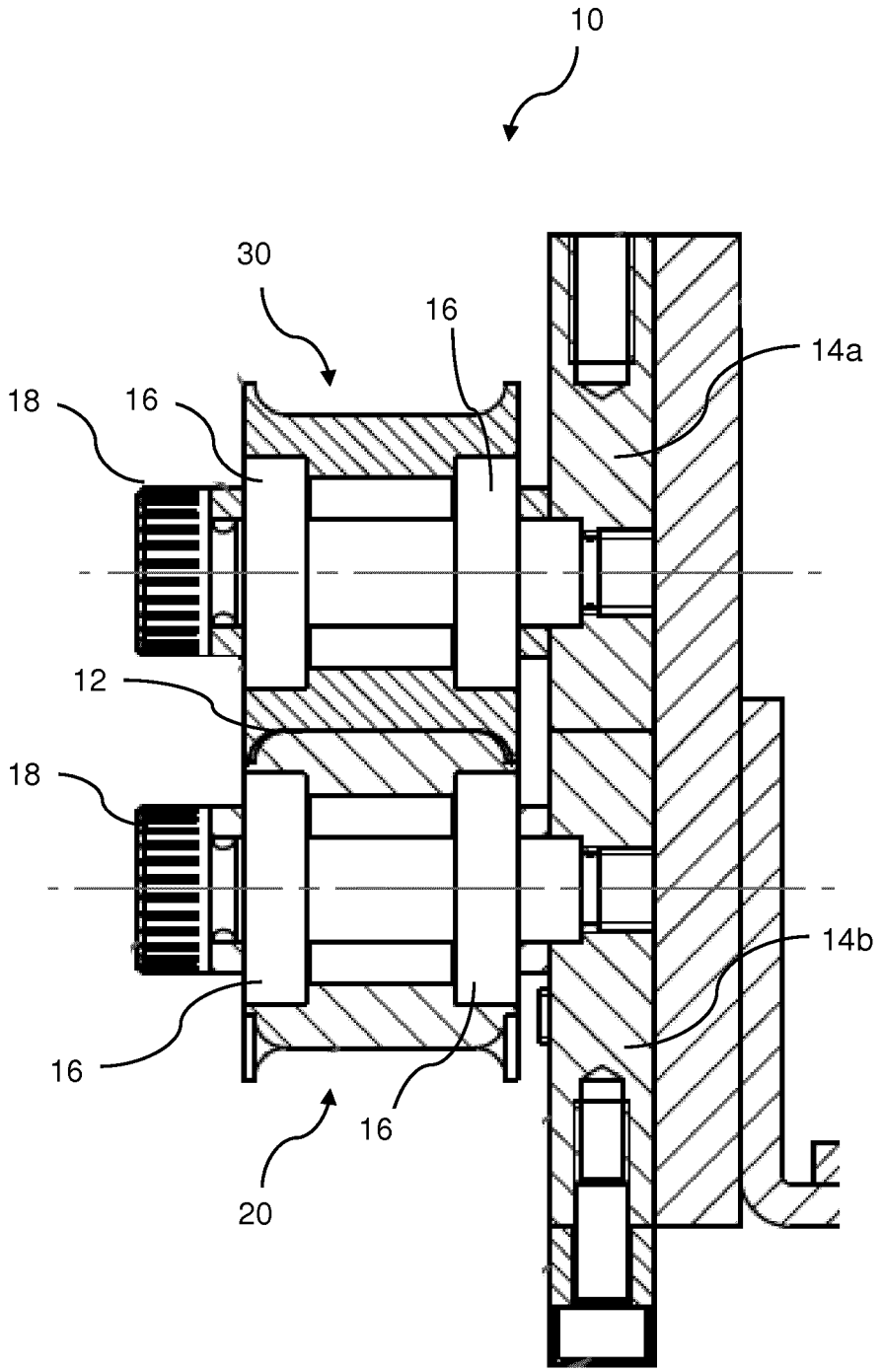
FIG. 4 shows a cross-section of an assembled roller pair.

In the apparatus 10 of the present invention the two rollers 20, 30 depicted in FIGS. 2 and 3 are mounted adjacent to each other so as to define a roller gap 12 there between as shown in FIG. 4. Each of the rollers 20, 30 is rotatably mounted to a corresponding roller support plate 14*a, b*. In the embodiment depicted in FIG. 4 the rollers 10, 30 are each set on two ball bearings 16 and are mounted to the support plates 14*a, b* via central screws 18. The central screws 18 also define the rotational axes of the rollers 20, 30.

The support plates 14*a, b* are mounted to an adjustable closing device (not shown in FIG. 4) which allows controlling the contact pressure between the rollers 20, 30.

In use of the apparatus 10, a continuous band of wrapping material is fed in processing direction of the wrapping material into the roller gap 12 defined by the roller pair 20, 30. In the configuration of FIG. 4 the processing direction is perpendicular to the drawing plane. Due to the special design of the roller gap 12, the lateral areas of the wrapping material are pressed and bent downwardly in the configuration as depicted in FIG. 4.

The wrapping material 40 may for example be a conventionally used wrapping paper. By bending and pressing the edges of the wrapping paper, the wrapping paper is prepared to adopt a round shape of the final product. Further bending and pressing the lateral regions of the wrapping paper weakens the internal structure of the wrapping paper. In particular stiff paper fibers oriented perpendicular to the processing direction of the wrapping paper are broken or weakened such that the overall softness of the wrapping paper is increased.

Figure 5:
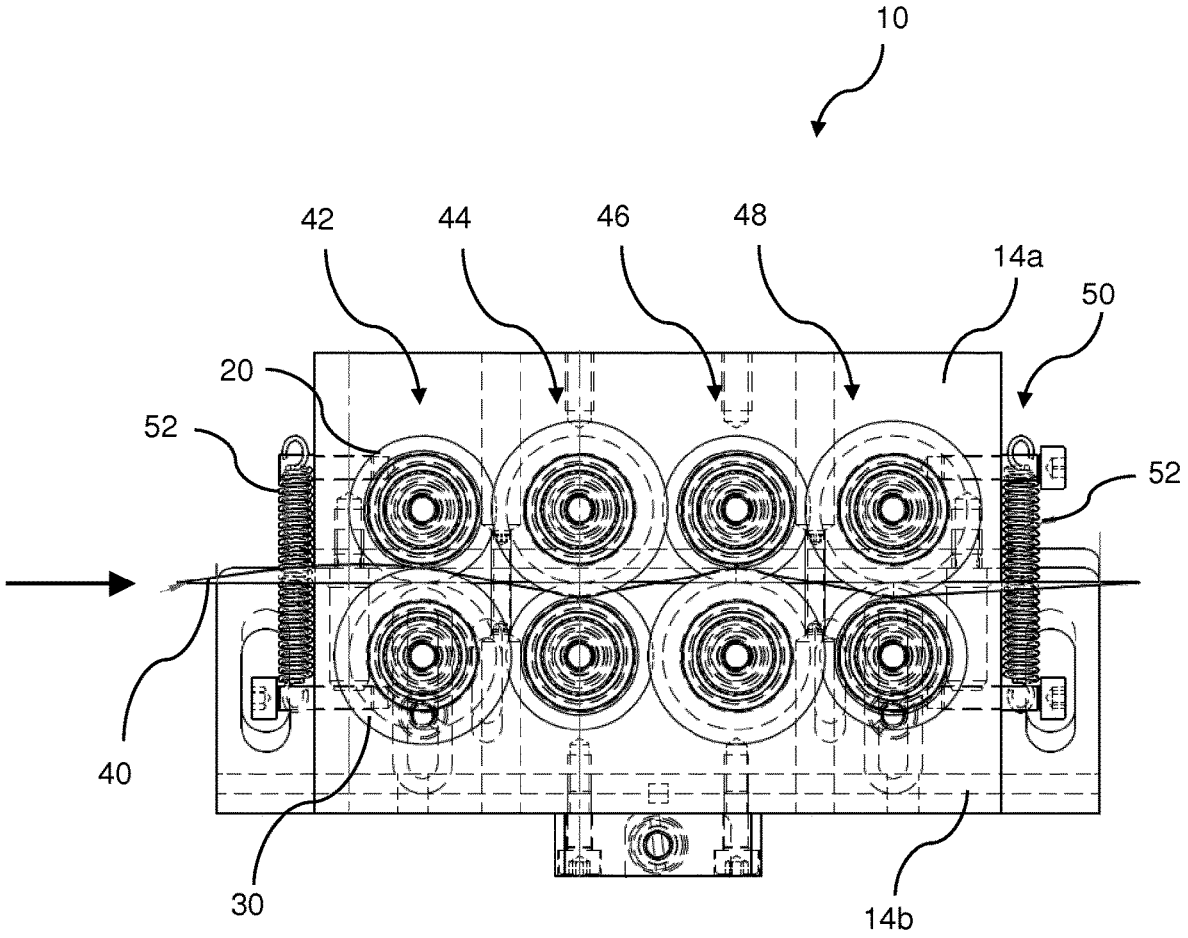
FIG. 5 shows an apparatus of the invention employing four roller pairs.

In FIG. 5 an apparatus 10 for treating wrapping material comprising four roller pairs 42, 44, 46, 48 is depicted. The roller pairs 42, 44, 46, 48 are sequentially arranged along the processing direction (indicated by the arrow) of the wrapping material 40, whereby consecutive roller pairs 42, 44, 46, 48 have alternating orientation. In processing direction of the wrapping paper, the first and the third roller pair 42, 46 are oriented such that the female roller 20 is located on top, while the second and the forth roller pair 44, 48 is orientated the other way around with the male roller 30 being located on top.

The upper rollers of each roller pair 42, 44, 46, 48 are all mounted to the upper support plate 14*a*, while the lower rollers of each roller pair 42, 44, 46, 48 are mounted to the lower support plate 14*b*. Upper and lower support plates 14*a*, 14*b* are adjustably mounted to a closing device 50, via which a contact pressure between the roller pairs 42, 44, 46, 48 may be adjusted. In the embodiment of FIG. 5 the closing device 50 comprises two adjustable tension springs 52 that allow controlling the contact pressure of the roller pairs 42, 44, 46, 48.

The rotational axes of the upper and the lower rollers are all mounted at the same height. Thus, the central portion of the wrapping material 40, that is the portion of the wrapping material 40 that is guided over the flat central surfaces 22, 32 of the rollers 20, 30 passes the apparatus 10 in a constant height and, thus, without being significant affected by the apparatus 10.

Due to the alternating orientation of the roller pairs 42, 44, 46, 48, the lateral regions of the wrapping paper 40, are alternately bent upward and downward. By this repeated up- and downward bending the rigidity of the lateral areas of the wrapping material 40 is reduced. Thus, the lateral areas of the wrapping material 40 are significantly softened and the wrapping material 40 is therefore well prepared for being formed into a rod shape by a downstream wrapping unit (not shown).

As mentioned above, in the embodiment of FIG. 5 the axes of the upper rollers are positioned at the same height and the axes of the lower rollers are positioned at the same height, respectively. Accordingly, the central areas of the wrapping material 40 are pulled at the same height through the apparatus 10. In an alternative embodiment (not shown) the roller pairs 42, 44, 46, 48 may also be alternately positioned at different heights such that the complete wrapping material 40 alternately travels upward and downward when being pulled through the apparatus 10. By positioning the roller pairs 42, 44, 46, 48 at different heights the wrapping material 40 is also bent in processing direction, which may further increase flexibility of the wrapping material 40.

As indicated above the present invention is particularly useful for treating wrapping paper. By positioning the roller pairs 42, 44, 46, 48 in alternating orientation and by additionally positioning the roller pairs 42, 44, 46, 48 at different heights, it is possible to simultaneously soften the wrapping paper fibers that are oriented perpendicular to the processing direction and also the wrapping paper fibers that are oriented in parallel to the processing direction of the continuous band of wrapping paper.

The exemplary embodiments described above illustrate but are not limiting. In view of the above discussed exemplary embodiments, other embodiments consistent with the above exemplary embodiments will now be apparent to one of ordinary skill in the art.

The invention claimed is:

1. An apparatus for processing a continuous band of wrapping material, comprising:

a roller pair defining a roller gap there between, the roller pair being part of a plurality of roller pairs, which are arranged in alternating orientation along a processing direction of the continuous band of wrapping material, such that lateral areas of the continuous band of wrapping material are alternately bent upwardly and downwardly, wherein the roller pair comprises rollers comprising a male and a female roller, wherein the rollers have matching convex and concave shapes, respectively, wherein both rollers have flat central roller areas, and wherein the female roller has convexly rounded edges, and the male roller has corresponding concavely rounded edges, such that the rollers are adapted to provide a continuous weakened region of the continuous band of wrapping material by displacing the region of the continuous band of wrapping material which is passing between a concavo-convex portion of the roller gap relative to the region of the continuous band of wrapping material which is passing between a flat central portion of the roller gap.

2. The apparatus according to claim 1, wherein the rollers are adapted to provide a continuous weakened lateral edge portion of the continuous band of wrapping material.

3. The apparatus according to claim 1, wherein the rollers have a diameter of between 10 and 50 millimeters.

4. The apparatus according to claim 1, wherein the width of the rollers is between 15 and 40 millimeters.

5. The apparatus according to claim 1, wherein the rounded edges of the rollers have a radius of curvature of between 1 and 5 millimeters.

6. The apparatus according to claim 1, comprising a closing device for controlling contact pressure between the female and male rollers and the continuous band of wrapping material passing therebetween in one or more roller pairs and wherein the closing device comprises adjustable resilient elements for controlling the contact pressure between each of the one or more roller pairs.

7. The apparatus according to claim 1, further comprising a glue applicator, wherein the glue applicator is configured to apply glue to a lateral area of the continuous band of wrapping material that has been guided through a curved area of the roller gap.

8. A method for processing a band of wrapping paper, comprising the steps of:

providing a continuous band of wrapping material, guiding the continuous band of wrapping material through a roller gap defined by a roller pair, providing the roller pair as part of a plurality of roller pairs in alternating heights with respect to the processing direction of the continuous band of wrapping material, wherein the roller pair comprises rollers comprising a male and a female roller, wherein both rollers have flat central roller areas, and wherein the female roller has convexly rounded edges, and the male roller has corresponding concavely rounded edges, wherein the rollers have matching convex and concave shapes, respectively, such that the rollers provide a continuous weakened region of the continuous band of wrapping material by displacing the region of the continuous band of wrapping material which is passing between a concavo-convex portion of the roller gap relative to the region of the continuous band of wrapping material which is passing between a flat central portion of the roller gap.

9. The method according to claim 8, wherein the rollers provide a continuous weakened lateral edge portion of the continuous band of wrapping material.

10. The method in accordance with claim 8, comprising the further step of:

controlling contact pressure between the female and male rollers and the continuous band of wrapping material passing therebetween in one or more roller pairs via a closing device.

11. An apparatus for processing a continuous band of wrapping material, comprising:

a roller pair defining a roller gap there between, the roller pair being part of a plurality of roller pairs, which are arranged in alternating orientation along a processing direction of the continuous band of wrapping material, such that lateral areas of the continuous band of wrapping material are alternately bent upwardly and downwardly, wherein consecutive roller pairs are positioned at different heights such that the wrapping material is also bent up and down in processing direction of the continuous band of wrapping material, wherein the roller pair comprises rollers comprising a male and a female roller, wherein the rollers have matching convex and concave shapes, respectively, wherein both rollers have flat central roller areas, and wherein the female roller has convexly rounded edges, and the male roller has corresponding concavely rounded edges, such that the rollers are adapted to provide a continuous weakened region of the continuous band of wrapping material by displacing the region of the continuous band of wrapping material which is passing between a concavo-convex portion of the roller gap relative to the region of the continuous band of wrapping material which is passing between a flat central portion of the roller gap.

12. The apparatus according to claim 11, wherein the rollers are adapted to provide a continuous weakened lateral edge portion of the continuous band of wrapping material.

13. The apparatus according to claim 11, wherein the rollers have a diameter of between 10 and 50 millimeters.

14. The apparatus according to claim 11, wherein the width of the rollers is between 15 and 40 millimeters.

15. The apparatus according to claim 11, wherein the rounded edges of the rollers have a radius of curvature of between 1 and 5 millimeters.

16. The apparatus according to claim 11, comprising a closing device for controlling contact pressure between the female and male rollers and the continuous band of wrapping material passing therebetween in one or more roller pairs and wherein the closing device comprises adjustable resilient elements for controlling the contact pressure between each of the one or more roller pairs.

17. The apparatus according to claim 11, further comprising a glue applicator, wherein the glue applicator is configured to apply glue to a lateral area of the continuous band of wrapping material that has been guided through a curved area of the roller gap.

* * * * *